US009546346B2

(12) United States Patent
Bjelopavlic et al.

(10) Patent No.: US 9,546,346 B2
(45) Date of Patent: Jan. 17, 2017

(54) USE OF POLYETHYLENE GLYCOL TO CONTROL THE SPRAY PATTERN OF SPRAYABLE LIQUID ABRASIVE CLEANSERS

(75) Inventors: Mick Bjelopavlic, Chandler, AZ (US); Joan M. Bergstrom, Phoenix, AZ (US); Felix Ayala-Fierro, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 1093 days.

(21) Appl. No.: 13/081,758

(22) Filed: Apr. 7, 2011

(65) Prior Publication Data

US 2012/0258904 A1 Oct. 11, 2012

(51) Int. Cl.

| | |
|---|---|
| ***C11D 9/20*** | (2006.01) |
| ***C11D 3/37*** | (2006.01) |
| ***C11D 3/12*** | (2006.01) |

(52) U.S. Cl.

CPC ..... *C11D 3/3707* (2013.01); *C11D 3/1233* (2013.01)

(58) Field of Classification Search

USPC ..... 510/397

See application file for complete search history.

(56) References Cited

U.S. PATENT DOCUMENTS

| | | | | |
|---|---|---|---|---|
| 3,061,202 | A | 10/1962 | Tyler | |
| 3,650,473 | A | 3/1972 | Malone | |
| 3,701,478 | A | 10/1972 | Tada | |
| 3,840,157 | A | 10/1974 | Hellenkamp | |
| 3,956,158 | A | 5/1976 | Donaldson | |
| 3,985,668 | A | 10/1976 | Hartman | |
| 4,005,027 | A | 1/1977 | Hartman | |
| 4,051,056 | A | 9/1977 | Hartman | |
| 4,082,223 | A | 4/1978 | Nozawa | |
| 4,161,288 | A | 7/1979 | McKinney | |
| 4,240,919 | A | 12/1980 | Chapman | |
| 4,352,678 | A | 10/1982 | Jones et al. | |
| 4,434,917 | A | 3/1984 | Saito et al. | |
| 4,527,741 | A | 7/1985 | Garneau | |
| 4,690,779 | A * | 9/1987 | Baker et al. | 510/433 |
| 4,704,222 | A | 11/1987 | Smith | |
| 4,706,888 | A | 11/1987 | Dobbs | |
| 4,747,523 | A | 5/1988 | Dobbs | |
| 4,779,803 | A | 10/1988 | Corsette | |
| 4,797,231 | A | 1/1989 | Schumann et al. | |
| 4,819,835 | A | 4/1989 | Tasaki | |
| 4,842,757 | A | 6/1989 | Reboa et al. | |
| 4,869,842 | A | 9/1989 | Denis et al. | |
| RE33,235 | E | 6/1990 | Corsette | |
| 5,156,304 | A | 10/1992 | Battegazzore | |
| 5,298,181 | A * | 3/1994 | Choy et al. | 510/369 |
| 5,303,867 | A | 4/1994 | Peterson | |
| 5,346,641 | A | 9/1994 | Argo et al. | |
| 5,397,506 | A | 3/1995 | Groth et al. | |
| 5,470,499 | A | 11/1995 | Choy et al. | |
| 5,529,711 | A | 6/1996 | Brodbeck et al. | |
| 5,821,214 | A | 10/1998 | Weibel | |
| 6,095,377 | A | 8/2000 | Sweeton et al. | |
| 6,126,090 | A | 10/2000 | Wadsworth et al. | |
| 6,131,820 | A | 10/2000 | Dodd | |
| 6,187,731 | B1 | 2/2001 | Moeller et al. | |
| 6,378,786 | B1 | 4/2002 | Beeston et al. | |
| 6,511,953 | B1 | 1/2003 | Fontana et al. | |
| 6,551,984 | B1 * | 4/2003 | Arvanitidou et al. | 510/463 |
| 2007/0068086 | A1 | 3/2007 | Akatsuka | |
| 2008/0026150 | A1 | 1/2008 | Mesa et al. | |
| 2010/0197557 | A1 | 8/2010 | Konishi | |

FOREIGN PATENT DOCUMENTS

| | | | |
|---|---|---|---|
| SU | 1473862 | A1 | 4/1989 |
| WO | 97/04059 | A1 | 2/1997 |
| WO | WO 01/31110 | A1 | 5/2001 |

OTHER PUBLICATIONS

Russian Notice of Allowance (Russian Appln. No. 2013149223) dated Jun. 28, 2016.

Д.г.пажи, "Распылители жидкостей","Химия", М., 1979, с т р. 14-27.

PCT International Search Report (PCT/US2012/032264) dated Oct. 12, 2012.

* cited by examiner

*Primary Examiner* — Ling Choi
*Assistant Examiner* — Thuy-Ai Nguyen
(74) *Attorney, Agent, or Firm* — P. Scott Smith

(57) ABSTRACT

Liquid abrasive cleanser compositions sprayable through conventional manual trigger sprayers comprise a polyalkylene glycol, a nonionic surfactant, a pH adjusting agent, an abrasive, and water, wherein sprayability is made possible by the addition of the polyalkylene glycol. The compositions that are sprayable and acceptable as hard surface cleaners comprise polyethylene glycol as the polyalkylene glycol. The addition of polyethylene glycol having molecular weight of from about 4,000 to about 1,000,000 dramatically increases the sprayer output volume of liquid abrasive compositions having greater than or equal to 10 wt. % calcium carbonate. Addition of polyethylene glycol of molecular weight of from about 4,000 to about 100,000 converts otherwise non-sprayable liquid abrasive compositions into reliably sprayable compositions. Addition of PEG having molecular weight from about 4,000 to about 100,000 also provides a method for controlling the spray pattern of sprayable liquid abrasive compositions, in particular a method for optimizing the diameter of a conical spray pattern produced from a manual trigger sprayer having a conical spray nozzle.

10 Claims, No Drawings

USE OF POLYETHYLENE GLYCOL TO CONTROL THE SPRAY PATTERN OF SPRAYABLE LIQUID ABRASIVE CLEANSERS

FIELD OF THE INVENTION

The present invention generally relates to hard surface cleaners and in particular to a method of controlling the spray pattern of a sprayable liquid abrasive cleanser composition sprayed from a manual trigger sprayer by addition of polyethylene glycol of specific molecular weight to the abrasive composition.

BACKGROUND OF THE INVENTION

Abrasive cleansers have been known for some time and are now common hard surface cleansers used in homes and institutions. Even more than a century ago, simple dry scouring powders such as Bon Ami® were in the marketplace. Eventually liquid abrasive cleansers emerged, giving the consumer the convenience of a "pre-wetted" abrasive material rather than a dry and often dusty powder. Such liquid abrasives, sometimes called cream or crème cleansers, include all-purpose hard surface cleansers and specialty cleansers such as metal and automobile polishes. Early examples of liquid cleansers included silica based abrasive cleansers, cleansers with clay thickeners, and stearate soap thickened slurries described in U.S. Pat. Nos. 3,985,668, 4,005,027 and 4,051,056 (Hartman), U.S. Pat. No. 4,352,678 (Jones, et al.), and U.S. Pat. No. 4,240,919 (Chapman). Much of this early technology incorporating insoluble abrasives gave way to more modern liquid cleansers with dissolvable or so-called "soft" abrasives. These products often employed calcium carbonate as the abrasive, with the amount of abrasive positioned very high to promote formula stability and to optimize cleaning performance. In spite of the high abrasive content, liquid abrasive cleansers had serious settling problems, often resulting in separation of a free liquid layer residing at the top of the product and a compacted sediment layer at the bottom. Such instability, or syneresis, is problematic for the end-user. Shaking of the liquid product is required prior to each use, and if the compacting of the sedimentary abrasive is severe, even shaking cannot restore the homogeneity of the abrasive suspension. Often the consumer doesn't read the label instructions to "shake before use" or otherwise doesn't think to shake the contents, only to be surprised to find clear thin liquid dispensed from the bottle of abrasive cleanser. Furthermore, none of these high weight percent abrasive suspensions were amenable to spraying through conventional non-aerosol trigger sprayers. These heavy suspensions, often comprising greater than 50 wt. % abrasives, are invariably packed in deformable plastic bottles equipped with closure comprising hinged lid and orifice. With these high abrasive content cream cleansers, the consumer has no choice but to purchase the product in this conventional package and to dispense it by "squirting" the product out through an orifice in the closure.

Many improvements to liquid abrasive cleansers have been described over the years. For example, U.S. Pat. No. 4,704,222 (Smith) discloses a gelled abrasive detergent composition comprising 25%-85% abrasive in a gel matrix of low MW polyethylene glycol and anionic surfactant. The composition also includes a polysulfonic acid that is believed to lubricate the abrasive particles rubbing against the surface to be cleaned, making the manual cleaning process easier.

U.S. Pat. No. 4,869,842 (Denis, et al.) describes an abrasive cleanser with improved degreasing performance through use of non-polar degreasing solvents. Allan also describes the use of degreasing hydrocarbon solvents in abrasive cleansers in PCT application WO98/49261.

U.S. Pat. No. 5,470,499 (Choy, et al.), U.S. Pat. No. 5,529,711 (Brodbeck, et al.), and U.S. Pat. No. 5,827,810 (Brodbeck, et al.) describe bleach-containing abrasive cleansers with improved cleaning performance, improved rinsing, and improved physical stability through use of a high-molecular weight cross-linked polyacrylate polymer.

U.S. Pat. No. 5,821,214 (Weibel) describes an improved liquid abrasive cleanser comprising very high molecular weight cross-linked polyacrylates along with smectite clays for stability.

U.S. Pat. No. 6,511,953 (Fontana, et al.) describes an abrasive cleanser with improved cleaning performance comprising both a nonionic surfactant and a sulfate anionic surfactant.

Very little is known regarding "sprayable" abrasive liquid cleansers. As mentioned, conventional aqueous-based cream cleansers having >50 wt. % abrasives are impossible to spray through a standard trigger sprayer. If a liquid abrasive cleanser even pumps into a standard manual trigger sprayer assembly, nothing is known about controlling the spray pattern of the product emanating from the trigger sprayer nozzle.

U.S. Pat. No. 6,378,786 (Beeston, et al.) discloses an abrasive composition that is claimed sprayable. However, the composition must be sprayed through a "pre-compression" trigger sprayer that is also disclosed in the reference. Pre-compression sprayers give a "burst" spray (single pressure), made possible when pressure in an inner chamber reaches a critical level set by a pre-compression spring. Such sprayers were pioneered by Piero Battegazzore of Guala S.p.A. in Italy (see e.g. U.S. Pat. No. 5,156,304, Battegazzore). The sprayable compositions disclosed in '786 reflect the necessary lowering of abrasive levels to make sprayability at least achievable, (e.g. 10 wt. % chalk, or 10 wt. % diatomaceous earth, rather than >50 wt. % calcite as typical in cream cleansers), yet the compositions nevertheless require a pre-compression burst trigger sprayer (e.g. a Guala sprayer) to make the compositions truly "sprayable."

U.S. Pat. No. 4,797,231 (Schumann, et al.) discloses a machine dishwashing polishing detergent that is, in a strict sense, sprayable, albeit through the electrically powered mechanical pump and spray jets of a dishwashing machine. The compositions comprise silica and/or alumina polishing particles that are water insoluble, various anionic and amphoteric surfactants, and a fat soluble solvent that optionally may include solvents like limonene, glycol ethers, or polyethylene glycol of molecular weight from about 200,000 to 4,000,000. Although these compositions have suspended particles (i.e. the polishing alumina and/or silica of the particle size found in toothpastes), the compositions "spray" only because of the powerful mechanical pressures achieved in mechanical dishwashing machines and the very fine particle size of the polishing ingredients.

Lastly, Konishi, et al. discloses stable, shear-thinning liquid abrasive cleanser compositions comprising calcium carbonate and non-crosslinked, hydrophobically modified, associative thickeners in U.S. Patent Application Publication 2010/0197557. However, even through the disclosed compositions are phase stable, shear-thinning and show a rethickening to cling on vertical surfaces, their dispensation remains practical only through the orifice provided in the closure of a standard squirt-bottle package.

In spite of the developments seen over many years, liquid abrasive cleansers still have problems with cleaning performance, phase stability, rinseability, and dispensation, with no teaching as to how to optimize these characteristics while balancing cost-of-goods. There are no high-performance liquid abrasive cleansers described in the prior art that show shear-thinning capability such that they can be easily sprayed from a standard manually-pumped trigger-sprayer package. To date, cream cleansers built with high enough abrasive content to be effective at cleaning remain precariously unstable in storage and unable to be sprayed through an ordinary non-aerosol trigger sprayer. Since there is such little known about sprayable liquid abrasive cleansers in general, it comes as no surprise that there is no prior art teaching how to control the spray pattern of a manually sprayed liquid abrasive cleanser.

For these reasons there is still a need to explore new combinations of surfactant, polymer, and abrasive ingredients that may provide for a low cost liquid abrasive cleanser that shows superior cleaning performance, cleaner rinsing, storage stability, and reliable dispensing. Of ultimate need is an aqueous, liquid abrasive cleanser having not only these attributes, but also the ability to be sprayed from an inexpensive standard non-aerosol spray bottle such as a trigger sprayer package, with control over the effluent spray pattern.

BRIEF SUMMARY OF THE INVENTION

It has now been surprisingly found that small amounts of polyalkylene glycol, and in particular, polyethylene glycol of molecular weight from about 4,000 to about 1,000,000, converts otherwise non-sprayable liquid abrasive compositions into compositions that are readily and reliable sprayable from a conventional manual trigger sprayer.

In an exemplary embodiment, the present invention comprises a liquid abrasive cleanser with superior cleaning performance that is sprayable through a conventional manual trigger sprayer.

In another exemplary embodiment of the present invention, an improved liquid abrasive cleanser composition comprises a polyalkylene glycol, a nonionic surfactant, a pH adjusting agent, an abrasive, and water, wherein the composition is sprayable through a conventional manual trigger sprayer.

In another exemplary embodiment of the present invention, an improved liquid abrasive cleanser composition comprises a polyethylene glycol having molecular weight from about 4,000 to about 1,000,000, a nonionic surfactant, an anionic surfactant, a pH adjusting agent, an abrasive, and water, wherein the composition is sprayable through a conventional manual trigger sprayer.

In another exemplary embodiment of the present invention, PEG with molecular weight of from about 4,000 to about 100,000 converts non-sprayable liquid abrasive compositions into sprayable compositions that reliable spray in conical spray patterns, whereas PEG with molecular weight of from about 300,000 to about 1,000,000 converts non-sprayable liquid abrasive compositions into compositions that are expelled from manual trigger sprayers in string/stream patterns.

In another exemplary embodiment of the present invention, a cleaning system comprises (1) a composition further comprising a polyethylene glycol having molecular weight from about 4,000 to about 1,000,000, a nonionic surfactant, an anionic surfactant, a pH adjusting agent, an abrasive and water; and (2) sprayer packaging comprising a spray bottle having an opening and an interior volume with the composition therein, and a manual trigger sprayer in fluid communication with the interior volume of the bottle and its liquid contents, wherein the composition is stored in and dispensed from the sprayer packaging through the manual trigger sprayer.

In another exemplary embodiment of the present invention, a method of converting a non-sprayable liquid abrasives composition into a sprayable composition comprises the steps of formulating a non-sprayable composition and adding polyethylene glycol to the non-sprayable composition to make it sprayable through a manual trigger sprayer.

In another exemplary embodiment of the present invention, a method of cleaning vertical surfaces in kitchens and bathroom comprises the steps of spraying a liquid abrasives composition through a manual trigger sprayer onto a soiled vertical surface, scrubbing if necessary, and rinsing or wiping to remove a substantial amount of the soil.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention. Various changes to the described embodiments may be made, for example in the function and relative amounts of the ingredients described without departing from the scope of the invention as set forth in the appended claims. Additionally, though described herein in general terms of a liquid abrasive cleanser that may be sprayed from a conventional, manually-operated trigger sprayer package, or dispensed in a flow stream such as from a deformable plastic bottle equipped with a suitable restrictive orifice or resilient valve closure, other embodiments of the invention such as wipes, pads, sponges or other cleaning implements/tools that are pre-wetted/treated or otherwise impregnated with some quantity of the liquid abrasive cleanser compositions described herein are within the scope of the present invention.

That being said, the present invention comprises sprayable liquid abrasive cleansers made possible by (1) a reduction of abrasive levels to a point where the liquid suspension shows at least some attributes of sprayability yet retains an acceptable level of cleaning performance; and (2) addition of a polyalkylene glycol, most preferably polyethylene glycol, to make the lower abrasives level composition reliably sprayable. Addition of polyalkylene glycol unexpectedly improves the sprayability of these low-abrasive content liquid cleansers that would not be reliably sprayable otherwise. Not wishing to be bound by any theory, the polyalkylene glycol may act as a lubricant for the abrasive particles, mitigating the clogging within the trigger sprayer components. The polyalkylene glycol may also alter the rheology of the liquid suspensions such that they flow more readily up the dip tubes of ordinary trigger sprayer assemblies. It's also possible that the polyalkylene glycol bonds to, and subsequently modifies, the surfaces of the plastic and/or metal parts of the trigger sprayer, and/or, the polymer forms hydrogen bonds between the sprayer components and abrasive cleanser ingredients such as the surfactants to improve the flow characteristics of the product through the sprayer. Whatever the inter-molecular interactions at play, the addition of polyalkylene glycol, and most particularly polyethylene glycol, dramatically and unexpectedly converts liquid cleanser compositions that would otherwise not be sprayable into truly sprayable compositions.

Furthermore, the molecular weight of the added polyethylene glycol affects the spray pattern emanating from a manual trigger sprayer. In particular, the diameter of the conical spray pattern of a liquid abrasive cleanser emanating from a manual trigger sprayer is found to be dependent on the molecular weight of the polyethylene glycol, and the addition of specific molecular weight polyethylene glycol can get the diameter of the spray cone back close to what is observed when water is sprayed through a trigger sprayer.

The compositions of the present invention minimally comprise a polyalkylene glycol, a nonionic surfactant, a pH adjusting agent, an abrasive, and water, wherein the composition has a pH of greater than 10 and is sprayable through a conventional manually-operated trigger sprayer. More preferred, the compositions of the present invention comprise a polyethylene glycol having molecular weight (MW) from about 4,000 to 1,000,000, a nonionic surfactant (e.g. alcohol ethoxylate, amine oxide, APG), an anionic surfactant (sulfate, sulfonate, fatty acid soap), a pH adjusting agent (e.g. alkali metal hydroxides, bicarbonates, citric acid, mineral acids, amines, alkanolamines or the like), an abrasive (e.g. calcium carbonate, talc), and water, wherein the composition has pH greater than 10 and is sprayable through a conventional manual trigger sprayer. As a form of liquid hard surface cleaner, the liquid abrasive cleanser compositions of the present invention may optionally comprise other polymers besides the polyalkyene glycol (e.g. for cleaning performance, rheology adjustment or surface modification), other surfactants, builders, additional buffers, various electrolytes, solvents (besides water, e.g. ethanol), colorants, fragrances, and preservatives, all of which are typically found at various levels and in various combinations in hard surface cleaners and scouring cleansers alike.

Standard Trigger Sprayers and Definition of Sprayability

Trigger sprayers, developed decades ago by such companies as AFA Corp, Owens, and Calmar, are now conventional and familiar, and available at low cost from many distributors both domestic and foreign. The combination of a blow-molded sprayer bottle, having narrow neck and threaded opening, with the conventional manually-operated trigger sprayer fitted to the opening and having a straw-type dip-tube positioned down into the bottle, form the most used and arguably the most recognizable package in the entire cleaning industry.

A conventional manual trigger sprayer for purposes of the present invention is assumed to mean an assembly either mounted directly to the top of a container of liquid, or connected remotely to a container of liquid via a tube extension, which has a trigger handle (hand-operated paddle) that can be pulled to cause pumping and dispensing of liquid from a nozzle in a stream or spray pattern, or foam, as dictated by the nozzle configuration. As mentioned, manually-operated trigger sprayers are exceedingly familiar to consumers, homeowners, maids, janitors, etc. for use with household cleaners, auto care products, lawn and garden products, pet care products, etc., and are disclosed in countless prior art references. A number of exemplary conventional sprayers are disclosed in the following references: U.S. Pat. No. 3,061,202 (Tyler); U.S. Pat. No. 3,650,473 (Malone); U.S. Pat. No. 3,701,478 (Tada); U.S. Pat. No. 3,840,157 (Hellenkamp); U.S. Pat. No. 4,082,223 (Nozawa); U.S. Pat. No. 4,161,288 (McKinney); U.S. Pat. No. 4,434,917 (Saito, et al.); U.S. Pat. No. 4,527,741 (Garneau); U.S. Pat. No. 4,747,523 (Dobbs); U.S. Pat. No. 4,779,803 (Corsette), U.S. Pat. No. 4,819,835 (Tasaki); U.S. Pat. No. 5,303,867 (Peterson); and RE 33,235 (Corsette), each incorporated herein in their entirety. Trigger sprayers, such as those disclosed in these references, are expected to minimally comprise a body with a bore including a cylindrical linear passageway, one end of which is placed in fluid communication with the liquid to be dispensed, either by connection to a dip-tube that is inserted into the bottle containing the liquid, or connected remotely by flexible tubing to the liquid, the other end of the bore connected to the outlet nozzle, and a piston within the passageway that operates to pump the liquid up the dip-tube and expel it out through the nozzle. Most trigger sprayers will also include a check valve of sorts to keep the system primed, at least for a short period of time, with liquid, and a spring mechanism to facilitate the manual pumping of the trigger lever (i.e. a spring attached either to the piston or to the lever to facilitate return of the lever to its starting position after it is pulled once by the operator). The preferred sprayer for the present invention, and for testing the present compositions for sprayability, may comprise these same internal components (body, bore, piston, lever, check valve, nozzle, etc.) as disclosed in the above-cited references. Thus, a conventional manual trigger sprayer is meant to refer to a pumped sprayer that requires hand-operation (i.e. manual pumping) to bring liquid up a dip-tube against the operation of gravity and to expel it out from the nozzle under the pressure created by a moving piston. A conventional trigger sprayer within the context of the present invention, and used herein for measuring sprayability, does not include pre-compression (or so-called burst sprayers) such as those disclosed in '786 (Beeston, et. al) or '304 (Battegazzore) cited above. Burst sprayers are expensive, although useful to dispense ordinarily non-sprayable compositions under pressure and also to unblock caked/dried materials left behind from the previous use. That being said, the preferred manual trigger sprayer for the present invention is the Calmar TS-800® trigger sprayer available from Saint-Gobain Calmar/Mead Westvaco, arguably one of the most widely used trigger sprayers in the world. This trigger sprayer is available with 0.65 mL, 0.90 mL, or 1.3 mL volume/stroke output. These sprayers feature a 302 stainless steel spring, a ⅛ inch ball valve, and a number of polypropylene components. It is disclosed by Dobbs in U.S. Pat. No. 4,747,523 (Calmar, Inc. assignee) incorporated herein by reference. The compositions of the present invention may, of course, be manually sprayed through any other brand/type of manual trigger sprayer, such as those disclosed in the references cited above. For example, another trigger sprayer for use with the present compositions, and the sprayer used herein to study the spray pattern of sprayed liquid abrasive compositions, included the Calmar® Mixor MP or HP model trigger sprayers, available with 1.0 mL (MP model only), 1.3 mL (MP or HP models), or 1.6 mL/stroke (HP model only) outputs, and disclosed in U.S. Pat. No. 6,095,377 (Sweeton, et al.) and U.S. Pat. No. 6,131,820 (Dodd), both incorporated herein in their entirety by reference. Additionally, the so-called "remote" trigger sprayers also find use with the compositions of the present invention. These sprayers are remotely connected to the container with the composition to be sprayed by flexible tubing that can carry the liquid from the container out to the hand-held trigger sprayer assembly. One such remote trigger sprayer is the Calmar® Mixor-HP Remote. The sprayers used herein for testing the sprayability of the abrasive compositions of the present invention and for measuring the shape/size of the spray pattern effluents for various compositions included: (1) the 0.9 mL/stroke output model of the Calmar® TS-800 trigger sprayer; and, (2) the 1.6 mL/stroke output model of the Calmar® Mixor HP trigger sprayer.

Sprayability, as the term is applied herein, is a rating assigned to a liquid composition if that liquid composition can be repeatedly and reliably dispensed from a standard sprayer package that comprises a spray bottle equipped with the Calmar® TS-800 manual trigger sprayer. To give a liquid composition a rating of sprayable, several qualitative and quantitative observations and measurements (collectively "attributes") are made when dispensing, or attempting to dispense, the composition through the Calmar® TS-800 sprayer, and these observations and measurements are then considered when making the judgment of sprayability. These attributes include: number of strokes required to prime the sprayer; the output volume (mL) per stroke (initially observed and at the end of a trial period, such as 1-month); the variability in the output volume per stroke; the "feel" of the trigger sprayer when actuated (i.e., the rebound characteristics of the trigger paddle, e.g. if the trigger doesn't rebound properly); the spray pattern of the sprayer output, (e.g. if the nozzle is configured to produce a conical spray pattern, is the spray output repeatedly conical shaped); and lastly, the reproducibility/reliability of that observed spray pattern. Obviously not all of these observations are necessarily recorded and factored into a final rating of "sprayable" or "non-sprayable." For example, if the trigger sprayer won't prime even with countless manual pumps of the trigger sprayer, the remaining attributes become moot, and based on this single observation, the composition is rated as non-sprayable. Also for example, if the trigger sprayer takes longer than about 10 strokes to prime, the mixture is considered non-sprayable. Additionally, if the sprayer output per stroke is less than about ⅔ the total possible output of the sprayer specification (which for the Calmar® TS-800 model selected for use herein is 0.9 mL/stroke, ⅔ of which corresponds to a minimum acceptable sprayer output of around 0.6 mL/stroke). Lastly, if a spray pattern is expected to be conical because of the spray nozzle configuration on the Calmar® TS-800 sprayer, a composition that expels from the sprayer in only a stream pattern (regardless of volume and strokes to prime) is considered "non-sprayable." In this way, the compositions of the present invention are deemed either "sprayable" or "non-sprayable."

Polyalkylene Glycol

The sprayable abrasive compositions of the present invention comprise select polyalkylene glycols in amounts sufficient to promote sprayability of the resulting composition through a standard trigger sprayer such as the Calmar TS-800®. Useful polyalkylene glycols for promoting sprayability of liquid abrasive compositions include polyethylene glycol (PEG), polypropylene glycol (PPG), EO/PO polymers (random, alternating or block co-polymers), or some low molecular weight polyols, or mixtures thereof, with the polyethylene glycols preferred. The preferred amount of polyalkylene glycol is from about 0.01 wt. % to about 0.50 wt. %, based on the total weight of the liquid abrasive composition. More preferred is to incorporate from about 0.01 wt. % to about 0.20 wt. % of polyethylene glycol (PEG) having molecular weight of from about 4,000 to about 1,000,000. Most preferred is to use from about 0.05 wt. % to about 0.15 wt. % of 4,000 to about 400,000 molecular weight polyethylene glycol.

The polyalkylene glycols for use in the present invention are polymers characterized by the general formula: HO—$(CRHCH_2O)_nH$, wherein R is selected from the group consisting of H, and methyl, and mixtures thereof, and n is an integer having an average value of from about 90 to about 23,000. When R=H, the materials are polymers of ethylene oxide and are commonly known as polyethylene oxides, polyoxyethylenes, polyethylene glycols, or simply "PEG." When R=methyl, these materials are polymers of propylene oxide and are commonly known as polypropylene oxides, polyoxypropylenes, polypropylene glycols, or simply "PPG." When R=methyl, positional isomers of these polymers can exist.

Specific examples of suitable polyethylene glycol polymers include: 3,600-4,400 MW polyethylene glycol (PEG-90, available as Carbowax® 4000 from Dow Chemical); 4,400-4,800 MW polyethylene glycol (PEG-100, available as Carbowax® 4600 from Dow Chemical); 7,000-9,000 MW polyethylene glycol (PEG-180, available as Carbowax® 8000 from Dow Chemical); 100,000 MW polyethylene glycol (available as Polyox® WSR N-10 from Dow Chemical); 200,000 MW polyethylene glycol (available as Polyox® WSR N-80 from Dow Chemical); 300,000 MW polyethylene glycol (available as Polyox® WSR N-750 from Dow Chemical); 400,000 MW polyethylene glycol (available as Polyox® WSR N-3000 from Dow Chemical); 600,000 MW polyethylene glycol (available as Polyox® WSR N-205 from Dow Chemical); 900,000 MW polyethylene glycol (available as Polyox® WSR N-1105 from Dow Chemical); 1,000,000 MW polyethylene glycol (available as Polyox® WSR N-12K from Dow Chemical); 2,000,000 MW polyethylene glycol (available as Polyox® WSR N-60K from Dow Chemical); 4,000,000 MW polyethylene glycol (available as Polyox® WSR-301 from Dow Chemical); 5,000,000 MW polyethylene glycol (available as Polyox® WSR Coagulant from Dow Chemical); and, 7,000,000 MW polyethylene glycol (available as Polyox® WSR-303 from Dow Chemical). Preferred are the approximate 4,000; 8,000; 100,000; 300,000; 400,000; and, 900,000 MW polyethylene glycols (available as Carbowax® 4000 and 8000, and Polox® WSR N-10, N-750, N-3000, and N-1105, respectively). More preferred is to use polyethylene glycol with molecular weight of from about 4,000 to about 400,000. Most preferred is to use from about 0.05 wt. % to about 0.15 wt. % of Polyox® WSR N-10 from Dow Chemical (100,000 MW PEG) in the liquid abrasive composition to make it sprayable.

Surfactants

The surfactants for use in the sprayable liquid abrasive cleanser compositions of the present invention may include various anionic and/or nonionic materials, although it is preferred to use at least one nonionic surfactant and at least one anionic surfactant in combination.

Preferred nonionic surfactants for use in the present liquid abrasive compositions include ethoxylated and/or propoxylated primary alcohols having alcohol chain lengths of 8 to 18 carbon atoms and on average from 3 to 18 moles of ethylene oxide (EO) and/or from 1 to 10 moles of propylene oxide (PO) per mole of alcohol. More preferred examples are alcohol ethoxylates containing linear radicals from alcohols of natural origin having 10 to 18 carbon atoms ethoxylated with an average of from 4 to about 12 moles EO per mole of alcohol. Commercially available nonionic alcohol ethoxylate surfactants that may find use herein include, but are not limited to, Neodol® 91-6, ($C_9$-$C_{11}$ alcohol ethoxylate-6EO surfactant); Neodol® 91-8, ($C_9$-$C_{11}$ alcohol ethoxylate-8EO surfactant); Neodol® 45-7, ($C_{14}$-$C_{15}$ alcohol ethoxylate-7EO surfactant), Neodol® 25-9, ($C_{12}$-$C_{15}$ alcohol ethoxylate-9EO surfactant) and Neodol® 25-12, ($C_{12}$-$C_{15}$ alcohol ethoxylate-12EO surfactant), each from Shell Chemical Company; Berol® 266, ($C_9$-$C_{11}$ alcohol ethoxylate-5.5EO surfactant), available from Akzo; and, Surfonic® L12-3, ($C_{10}$-$C_{12}$ alcohol ethoxylate-3EO surfactant), Surfonic® L12-6, ($C_{10}$-$C_{12}$ alcohol ethoxylate-6EO surfactant), Surfonic® L12-8, ($C_{10}$-$C_{12}$ alcohol ethoxylate-8EO surfactant), Surfonic® L24-2, ($C_{12}$-$C_{14}$ alcohol ethoxylate-2EO surfactant), Surfonic® L24-3, ($C_{12}$-$C_{14}$ alcohol ethoxylate-3EO surfactant), Surfonic® L24-7, ($C_{12}$-$C_{14}$ alcohol ethoxylate-7EO surfactant), Surfonic® L24-9, ($C_{12}$-$C_{14}$ alcohol ethoxylate-9EO surfactant), Surfonic® L24-12, ($C_{12}$-$C_{14}$ alcohol ethoxylate-12EO surfactant), Surfonic® L46-7, ($C_{14}$-$C_{16}$ alcohol ethoxylate-7EO surfactant), and Surfonic® L68-18, ($C_{16}$-$C_{18}$ alcohol ethoxylate-18EO surfactant), each available from Huntsman. Combinations of more than one alcohol ethoxylate surfactant may also be desired in the sprayable abrasives composition in order to maximize cleaning of various home and institutional surfaces and to improve stability. Any of the above mentioned alcohol alkoxylate surfactants may be incorporated in the compositions of the present invention, in any combination, for a total level of from about 0.5 wt. % to about 10 wt. %, based on the total weight of the abrasives composition. More preferred is to use from about 1 wt. % to about 5 wt. % of a $C_{10}$-$C_{12}$ alcohol ethoxylate, and most preferred is to incorporate from about 1 wt. % to about 5 wt. % of a $C_{10}$-$C_{12}$ alcohol ethoxylate-8EO such as Surfonic® L12-8 from Huntsman (also available as HSC-800 NRE® from Huntsman).

The abrasive compositions of the present invention may also include additional nonionic surfactant such as the alkyl polyglycoside surfactants. The alkyl polyglycosides (APGs) also called alkyl polyglucosides if the saccharide moiety is glucose, are naturally derived, nonionic surfactants. The alkyl polyglycosides that may be used in the present invention are fatty ester derivatives of saccharides or polysaccharides that are formed when a carbohydrate is reacted under acidic condition with a fatty alcohol through condensation polymerization. The APGs are typically derived from corn-based carbohydrates and fatty alcohols from natural oils in animals, coconuts and palm kernels. The alkyl polyglycosides that are preferred for use in the present invention contain a hydrophilic group derived from carbohydrates and is composed of one or more anhydroglucose units. Each of the glucose units can have two ether oxygen atoms and three hydroxyl groups, along with a terminal hydroxyl group, which together impart water solubility to the glycoside. The presence of the alkyl carbon chain leads to the hydrophobic tail to the molecule. When carbohydrate molecules react with fatty alcohol compounds, alkyl polyglycoside molecules are formed having single or multiple anhydroglucose units, which are termed monoglycosides and polyglycosides, respectively. The final alkyl polyglycoside product typically has a distribution of varying concentration of glucose units (or degree of polymerization).

The APG's that may be used in the abrasive cleanser compositions of the present invention preferably comprise saccharide or polysaccharide groups (i.e., mono-, di-, tri-, etc. saccharides) of hexose or pentose, and a fatty aliphatic group having 6 to 20 carbon atoms. Preferred alkyl polyglycosides that can be used according to the present invention are represented by the general formula, $G_x$-O—$R^1$, wherein G is a moiety derived from reducing saccharide containing 5 or 6 carbon atoms, e.g., pentose or hexose; $R^1$ is fatty alkyl group containing 6 to 20 carbon atoms; and x is the degree of polymerization of the polyglycoside, representing the number of monosaccharide repeating units in the polyglycoside. Generally, x is an integer on the basis of individual molecules, but because there are statistical variations in the manufacturing process for APGs, x may be a noninteger on an average basis when referred to APG used as an ingredient for the compositions of the present invention. For the APGs of use in the compositions of the present invention, x preferably has a value of less than 2.5, and more preferably is between 1 and 2. Exemplary saccharides from which G can be derived are glucose, fructose, mannose, galactose, talose, gulose, allose, altrose, idose, arabinose, xylose, lyxose and ribose. Because of the ready availability of glucose, glucose is preferred in polyglycosides. The fatty alkyl group is preferably saturated, although unsaturated fatty chains may be used. Generally, the commercially available polyglycosides have $C_8$ to $C_{16}$ alkyl chains and an average degree of polymerization of from 1.4 to 1.6.

Commercially available alkyl polyglycoside can be obtained as concentrated aqueous solutions ranging from 50 to 70% actives and are available from Cognis. Most preferred for use in the present compositions are APGs with an average degree of polymerization of from 1.4 to 1.7 and the chain lengths of the aliphatic groups are between $C_8$ and $C_{16}$. For example, one preferred APG for use herein has chain length of $C_8$ and $C_{10}$ (ratio of 45:55) and a degree of polymerization of 1.7. These alkyl polyglycosides are also biodegradable in both anaerobic and aerobic conditions and they exhibit low toxicity to plants, thus improving the environmental profile of the present invention. The liquid abrasive cleanser compositions may include a sufficient amount of alkyl polyglycoside surfactant in an amount that provides a desired level of hard surface cleaning and rinseability. For example, alkyl polyglycoside may be used as a nonionic surfactant in the present compositions at a level of from about 0.5 wt. % to about 10 wt. %, based on the total weight of the composition.

Also of use as the nonionic surfactant component for the present composition are the amine oxide surfactants, including mono-long chain, di-short chain, and the trialkyl amine oxides, have the general formula $RR'R''N^+—O^-$, wherein R=$C_{6-24}$ alkyl, and R', R''=$C_{1-4}$ alkyl or $C_{1-4}$ hydroxyalkyl, where R' and R'' are not necessarily identical. Preferred for use in hard surface cleaners such as the present inventive compositions are the alkyl dimethyl amine oxides such as lauryl dimethyl amine oxide, myristyl dimethyl amine oxide, dimethyl cocoamine oxide, dimethyl (hydrogenated tallow) amine oxide, and myristyl/palmityl dimethyl amine oxide. Further useful amine oxides include alkyl di(hydroxy lower alkyl)amine oxides in which the alkyl group has about 10-20, and preferably 12-16 carbon atoms, and wherein the alkyl group may be straight or branched chain, saturated or unsaturated. Examples include bis(2-hydroxyethyl)cocoamine oxide, bis(2-hydroxyethyl)tallow amine oxide, and bis (2-hydroxyethyl)stearylamine oxide. Additional useful amine oxides as nonionic surfactants for the present invention include alkylamidopropyl di(lower alkyl)amine oxides in which the alkyl group has about 10-20, and preferably 12-16 carbon atoms, wherein the alkyl group may be straight or branched chain, saturated or unsaturated. Examples include cocoamidopropyl dimethyl amine oxide and tallowamidopropyl dimethyl amine oxide. These above-mentioned surfactants are available from Lonza under the trade name Barlox® and from Stepan under the trade name Ammonyx®. Most preferred is to incorporate lauryl dimethyl amine oxide, or myristyl dimethyl amine oxide, or a mixture of the two surfactants.

The total level of nonionic surfactant in the liquid abrasive cleanser of the present invention is preferably from about 0.5% to about 10% by weight of the composition and more preferably from about 1% to about 5%. The nonionic surfactant component may be a single surfactant (e.g., just one alcohol ethoxylate) or blends of similar types of materials (e.g., at least one alcohol ethoxylate), or may be blends of dissimilar nonionic materials, (e.g., any combination of the various alcohol ethoxylates, alkylpolyglycosides, and amine oxides discussed above).

Anionic surfactants may also find use in the abrasive cleansers of the present invention, preferably as a surfactant mixture with at least one nonionic surfactant described above. Anionic surfactants that may find use in the abrasive cleansers of the present invention include the sulfates and sulfonates. Alkyl sulfates, also known as alcohol sulfates, have the general formula R—O—$SO_3$Na where R is from about 10 to 18 carbon atoms, and these materials may also be denoted as sulfuric monoesters of $C_{10}$-$C_{18}$ alcohols, examples being sodium decyl sulfate, sodium palmityl alkyl sulfate, sodium myristyl alkyl sulfate, sodium dodecyl sulfate, sodium tallow alkyl sulfate, sodium coconut alkyl sulfate, and mixtures of these surfactants, or of $C_{10}$-$C_{20}$ oxo alcohols, and those monoesters of secondary alcohols of this chain length. Also useful are the alk(en)yl sulfates of said chain length which contain a synthetic straight-chain alkyl radical prepared on a petrochemical basis, these sulfates possessing degradation properties similar to those of the corresponding compounds based on fatty-chemical raw materials. From a detergency/cleaning standpoint and for stability of the abrasives suspension, $C_{12}$-$C_{16}$-alkyl sulfates and $C_{12}$-$C_{15}$-alkyl sulfates, and also $C_{14}$-$C_{15}$ alkyl sulfates, are preferred. In addition, 2,3-alkyl sulfates, which may for example be obtained as commercial products from Shell Oil Company under the brand name DAN®, are suitable anionic surfactants. Most preferred is to use powdered or diluted liquid sodium lauryl sulfate from the Stepan Company, recognized under the trade name of Polystep®. The preferred level of alcohol sulfate in the present invention is from about 0.1% to about 20% by weight to total weight of the composition. Most preferred is from about 1% to about 10% as determined on an actives basis.

Also with respect to the anionic surfactants useful in the liquid abrasive cleanser compositions of the present invention, the alkyl ether sulfates, also known as alcohol ether sulfates, are preferred. Alcohol ether sulfates are the sulfuric monoesters of the straight chain or branched alcohol ethoxylates and have the general formula R—$(CH_2CH_2O)_x$—$SO_3$M, where R—$(CH_2CH_2O)_x$— preferably comprises $C_7$-$C_{21}$ alcohol ethoxylated with from about 0.5 to about 16 mol of ethylene oxide (x=0.5 to 16 EO), such as $C_{12}$-$C_{18}$ alcohols containing from 0.5 to 16 EO, and where M is alkali metal or ammonium, alkyl ammonium or alkanol ammonium counterion. Preferred alkyl ether sulfates for use in one embodiment of the present invention are $C_8$-$C_{18}$ alcohol ether sulfates with a degree of ethoxylation of from about 0.5 to about 16 ethylene oxide moieties and most preferred are the $C_{12}$-$C_{15}$ alcohol ether sulfates with ethoxylation from about 4 to about 12 ethylene oxide moieties. It is understood that when referring to alkyl ether sulfates, these substances are already salts (hence "sulfate"), and most preferred and most readily available are the sodium alkyl ether sulfates (also referred to as NaAES). Commercially available alkyl ether sulfates include the CALFOAM® alcohol ether sulfates from Pilot Chemical, the EMAL®, LEVENOL® and LATEMAL® products from Kao Corporation, and the POLYSTEP® products from Stepan, however most of these have fairly low EO content (e.g., average 3 or 4-EO). Alternatively the alkyl ether sulfates for use in the present invention may be prepared by sulfonation of alcohol ethoxylates (i.e., nonionic surfactants) if the commercial alkyl ether sulfate with the desired chain lengths and EO content are not easily found, but perhaps where the nonionic alcohol ethoxylate starting material may be. The preferred level of $C_{12}$-$C_{18}$/0.5-9EO alkyl ether sulfate in the present invention is from about 0.1% to about 20%. Most preferred is from about 1% to about 10% on an actives basis.

The more preferred anionic surfactants for use in the present compositions include sulfonate types such as the $C_{9-13}$ alkylbenzenesulfonates, olefinsulfonates, i.e. mixtures of alkenesulfonates and hydroxyalkanesulfonates and also disulfonates, as are obtained, for example, from $C_{12-18}$-monoolefins having a terminal or internal double bond by sulfonating with gaseous sulfur trioxide followed by alkaline or acidic hydrolysis of the sulfonation products. Sulfonates that are the most preferred for use in the cleanser compositions of the present invention include the alkyl benzene sulfonate salts. Suitable alkyl benzene sulfonates include the sodium, potassium, ammonium, lower alkyl ammonium and lower alkanol ammonium salts of straight or branched-chain alkyl benzene sulfonic acids. Alkyl benzene sulfonic acids useful as precursors for these surfactants include decyl benzene sulfonic acid, undecyl benzene sulfonic acid, dodecyl benzene sulfonic acid, tridecyl benzene sulfonic acid, tetrapropylene benzene sulfonic acid and mixtures thereof. Preferred sulfonic acids, functioning as precursors to the alkyl benzene sulfonates useful for compositions herein, are those in which the alkyl chain is linear and averages about 8 to 16 carbon atoms ($C_8$-$C_{16}$) in length. Examples of commercially available alkyl benzene sulfonic acids useful in the present invention include Calsoft® LAS-99, Calsoft®LPS-99 or Calsoft®TSA-99 marketed by the Pilot Chemical Company. Most preferred for use in the present invention is sodium dodecylbenzene sulfonate, available commercially as the sodium salt of the sulfonic acid, for example Calsoft® F-90, Calsoft® P-85, Calsoft® L-60, Calsoft® L-50, or Calsoft® L-40. Also of use in the present invention are the ammonium salts, lower alkyl ammonium salts and the lower alkanol ammonium salts of linear alkyl benzene sulfonic acid, such as triethanol ammonium linear alkyl benzene sulfonate including Calsoft® T-60 marketed by the Pilot Chemical Company. The preferred level of sulfonate surfactant in the present invention is from about 0.1% to about 20%. Most preferred is to use sodium dodecylbenzene sulfonate at a level of from about 1% to about 10% by weigh on an actives basis to the total composition.

Additional anionic materials that may be necessary for improved detergency and phase stability of the composition, and/or improved rinseability of the abrasives from hard surfaces, include the salts of alkylsulfosuccinic acid, which are also referred to as sulfosuccinates or as sulfosuccinic esters and which constitute the monoesters and/or diesters of sulfosuccinic acid with alcohols, preferably fatty alcohols and especially ethoxylated fatty alcohols. Preferred sulfosuccinates comprise $C_{8-18}$ fatty alcohol radicals or mixtures thereof. Especially preferred sulfosuccinates contain a fatty alcohol radical derived from ethoxylated fatty alcohols. Particularly preferred are the sulfosuccinates whose fatty alcohol radicals are derived from ethoxylated fatty alcohols having a narrowed homolog distribution. The anionic sulfosuccinate surfactant may be present in the composition from about 0.5% to about 20% by weight of the composition, and more preferably from about 1% to about 10% by weight of composition.

The compositions of the present invention may also include fatty acid soaps as an anionic surfactant component. The fatty acids that may find use in the present invention may be represented by the general formula R—COOH, wherein R represents a linear or branched alkyl or alkenyl group having between about 8 and 24 carbons. It is understood that within the compositions of the present invention, the free fatty acid form (the carboxylic acid) will be converted to the carboxylate salt in-situ (that is, to the fatty acid soap), by the excess alkalinity present in the composition from added pH adjusting agent and/or the abrasives. As used herein, "soap" means salts of fatty acids. Thus, after mixing and obtaining the compositions of the present invention, the fatty acids will be present in the composition as R—COOM, wherein R represents a linear or branched alkyl or alkenyl group having between about 8 and 24 carbons and M represents an alkali metal such as sodium or potassium, or an alkaline earth metal such as $Ca^{2+}$. The fatty acid soap is preferably comprised of higher fatty acid soaps. The fatty acids that are added directly into the compositions of the present invention may be derived from natural fats and oils, such as those from animal fats and greases and/or from vegetable and seed oils, for example, tallow, hydrogenated tallow, whale oil, fish oil, grease, lard, coconut oil, palm oil, palm kernel oil, olive oil, peanut oil, corn oil, sesame oil, rice bran oil, cottonseed oil, babassu oil, soybean oil, castor oil, and mixtures thereof. Although fatty acids can be synthetically prepared, for example, by the oxidation of petroleum, or by hydrogenation of carbon monoxide by the Fischer-Tropsch process, the naturally obtainable fats and oils are preferred. The fatty acids of particular use in the present invention are linear or branched and containing from about 8 to about 24 carbon atoms, preferably from about 10 to about 20 carbon atoms and most preferably from about 14 to about 18 carbon atoms. Preferred fatty acids for use in the present invention are tallow or hydrogenated tallow fatty acids. Preferred salts of the fatty acids are alkali metal salts, such as sodium and potassium or mixtures thereof and, as mentioned above, preferably the soaps generated in-situ by neutralization of the fatty acids with excess alkali also present in the compositions. Other useful soaps are ammonium and alkanol ammonium salts of fatty acids, most particularly the monoethanolammonium fatty soap prepared in situ by the neutralization of a fatty acid with monoethanolamine (MEA). The fatty acids that may be included in the present compositions will preferably be chosen to have desirable detergency, rinseability and suspension stabilizing effects. Fatty acid soaps may be incorporated in the compositions of the present invention at from about 1% to about 10%.

As mentioned, it is preferred to incorporate both nonionic and anionic surfactant components into the sprayable liquid abrasive compositions of the present invention. It is preferable to incorporate from about 0.5 wt. % to about 10 wt. % of nonionic surfactant and from about 0.1 wt. % to about 20 wt. % of anionic surfactant. More preferred is to use a combination of: (1) a total of from about 1 wt. % to about 5 wt. % of an alcohol ethoxylate, an amine oxide, or a mixture of the two, as the nonionic component; and, (2) a total of from about 1 wt. % to about 10 wt. % of an aryl sulfonate, a fatty acid, or a mixture of the two, as the anionic component. Most preferred is to use a combination of from about 1 wt. % to about 5 wt. % of an alcohol ethoxylate as the nonionic component and from about 1 wt. % to about 10 wt. % of a dodecylbenzene sulfonate as the anionic surfactant.

The pH Adjusting Agent

Although the abrasive cleanser compositions of the present invention include alkaline abrasives such as calcium carbonate which tend to increase pH, it is more efficient to add separate alkaline and/or acidic materials that are more readily soluble in water in order to adjust (and buffer) the composition to a desired final alkaline pH.

Materials useful to increase the pH of the compositions may comprise any alkali metal or alkaline earth hydroxide, (e.g., NaOH, KOH, $Mg(OH)_2$, and the like), or ammonia/ammonium hydroxide ($NH_3$, $NH_4OH$), any alkylamine (primary, secondary or tertiary amine), or any alkanolamine (monoethanolamine, diethanolamine, or triethanolamine, for example). Besides these, other alkaline materials may be used including soluble carbonates, sesquicarbonates, bicarbonates, borates, citrates, silicates, and such. Preferred alkaline agents for use in the present invention include but are not limited to sodium hydroxide (NaOH), potassium hydroxide (KOH), magnesium hydroxide ($Mg(OH)_2$), ammonium hydroxide, ammonia, primary amines, secondary amines, tertiary amines, monoethanolamine (MEA), diethanolamine (DEA), triethanolamine (TEA), sodium carbonate ($Na_2CO_3$), potassium carbonate ($K_2CO_3$), sodium bicarbonate ($NaHCO_3$), potassium bicarbonate ($KHCO_3$), sodium sesquicarbonate ($Na_2CO_3.NaHCO_3.2H_2O$), sodium silicate ($SiO_2/Na_2O$), sodium borate ($Na_2B_4O_7$—$(H_2O)_{10}$ or "borax"), monosodium citrate ($NaC_6H_7O_7$), disodium citrate ($Na_2C_6H_6O_7$), and trisodium citrate ($Na_3C_6H_5O_7$), and mixtures thereof.

Materials useful for reducing the pH (and hence buffering the composition when used in conjunction with an alkaline pH adjusting material) include organic or inorganic acids, mixtures of organic acids, mixtures of inorganic acids, or various combinations of organic and inorganic acids. The organic and/or inorganic acids for use in the present invention may be any acids known to those skilled in specialty chemicals and formulating cleaners in general, however, it is preferred to use at least one organic acid (e.g. citric, acetic, malic, lactic, oxalic, ascorbic, formic acid, or the like). Stronger acids such as hydrochloric, nitric, sulfamic, sulfuric, methane sulfuric, and phosphoric acids are all useful as well and in any combination. Most preferred is to incorporate citric acid as the acidic pH adjusting/buffering agent for the present compositions because it is known to act as a chelant as well in cleaning compositions.

The pH-adjusting agent(s) is/are typically incorporated at from about 0.01% to about 5.0%, or at the level necessary to buffer the composition to an alkaline pH target of greater than 7. More or less alkaline material may be added to achieve the target if, for example, there are greater or lesser amounts of a surfactant to neutralize (e.g., a sulfonic acid requiring neutralization to a sulfonate, or a free fatty acid requiring neutralization to a fatty acid soap). Selection of the pH adjusting agent(s) may also be influenced by the optional presence of halogen or oxygen bleach in the liquid abrasive cleanser, (for example, avoiding the use of ammonia or amines when hypochlorite bleach is present and recognizing that trade bleach is quite alkaline due to free sodium hydroxide present).

That being said, the target pH for the final composition is preferably greater than 7 and most preferably greater than or equal to about 10. It is preferable to achieve and stabilize at that target pH using from about 0.01% to about 2.0% by weight of alkaline materials such as sodium hydroxide and/or sodium bicarbonate, along with from about 0.1% to about 5% by weight of acidic materials such as citric acid or other combinations of organic and/or inorganic acids.

The Abrasive

Abrasives are incorporated in the present invention to promote cleaning action by providing scouring when the liquid cleansers of the invention are used on hard surfaces.

Preferred abrasives include calcium carbonate, but other abrasives such as silica sand, perlite, which is expanded silica, and various other insoluble, inorganic particulate abrasives can be used, such as quartz, pumice, feldspar, talc, labradorite, melamine granules, urea formaldehyde, tripolyphosphates and calcium phosphate. Most preferred is to use calcium carbonate in amounts ranging from about 0.5% to 70% and more preferably between about 1% and 30% by weight of the composition. As discussed above, reduction in the amount of calcium carbonate is necessary to get the compositions to a rheology such that there is a possibility of sprayability through a manual trigger sprayer. That being said, instead of calcium carbonate levels up around 50% by weight or more, the present compositions comprise much lower amounts. Most preferred is to use only from about 1.0% to about 30% by weight calcium carbonate rather than 50% or more seen in typical scouring crèmes.

Optional Solvent

Also useful in the present invention are one or more solvents besides the water diluent. Solvents may assist with cleaning performance and rinseability and in particular may be used to help dissolve greasy soils derived from body wash emollients in the bathroom or food fats/spatter in the kitchen. Solvents that may be included in the present abrasive cleanser compositions include ethanol, isopropanol, n-propanol, n-butanol, MP-Diol (methylpropanediol), ethylene glycol, propylene glycol, and other small molecular weight alkanols, diols, and polyols, ethers, and hydrocarbons (e.g. terpenes), and mixtures thereof, that may assist in cleaning when used at a level of from about 0.5% to about 5%. Satisfactory glycol ethers for use in the present compositions include ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate. When these glycol type solvents may be incorporated at a level of from about 0.5 to about 10%, and more preferably about 0.5% to about 5%. While all of the aforementioned glycol ether compounds assist with cleaning, the most preferred include diethylene glycol monobutyl ether or diethylene glycol monomethyl ether. The preferred solvents for the present invention include ethanol, isopropanol, MP-Diol, the various glycol ether solvents and terpenes such as d-limonene or natural citrus oils such as orange or lemon oil, with the preferred levels of from about 0.5% to about 5% by weight in the composition.

Dyes, Fragrances, Preservatives, Etc.

The compositions of the present invention may also include fragrances or masking agents or fragrance accords that negate or make more pleasant the use of the abrasive cleansers. Fragrances may be added at levels recommended by the fragrance suppliers or that add a noticeable yet not overwhelming scent to the product.

Additionally, the compositions of the present invention may include various dyes, pigments or other colorants to make the mixture more attractive to the consumer, or to make it strongly colored enough to see where it has been applied and how much has been applied. For example, when cleaning white ceramic bathroom tile it may be desirable to use a cleanser that is not white colored and hence a composition with dye added may be more useful. Soluble dyes or pigments may be added at the levels necessary to impart a consumer perceivable and consumer preferred level of color but perhaps not so much as to stain white grout around bathroom tiles.

Conventional preservatives may be added to the compositions to improve shelf life by inhibiting mold and bacteria growth. The preferred preservatives are available from Rohm and Haas under the trade name of Kathon® or from Thor under the trade name Acticide®. For example, of particular use as a preservative for the liquid abrasive cleansers of the present invention is Acticide® MBS. Preferred use levels for the preservatives are as recommended by the manufacturers of these materials and communicated in their technical bulletins, or at the level that provides effective bacteria and mold inhibition, (e.g. from about 0.001% to about 1.0% actives Acticide® MBS). Optionally, ultraviolet-absorbing materials may be added to mitigate dye fading and other stability issues that are light induced. Such materials are available from Ciba. These materials are important when packaging the cleanser compositions of the present invention in packaging that otherwise does not provide for uv blocking.

Optional Electrolytes

The compositions of the present invention may also include various electrolytes to render visible improvements to the cleanser formula (e.g. add or decrease or otherwise stabilize viscosity, stabilize suspensions from synerisis, and/or to affect/modulate foam height/stability). Electrolytes that may find use here include the common chloride salts such as sodium, potassium, lithium, magnesium, calcium, zinc chloride, and the like, and the sulfates such as sodium, magnesium or potassium sulfate. Such electrolytes may be added in any combination and preferably at a level of from about 0.01% to about 10% by weight of the total composition. More preferred is to use from about 0.1% to about 5% by weight of sodium chloride in the present compositions, and most preferably about 1.3% to about 3.0% by weight, to control viscosity and stabilize the liquid present abrasive compositions.

Compositions and Performance Data

TABLE 1 summarizes various embodiments of the liquid abrasive cleanser compositions according to the present invention. This table delineates composition (in weight percent, wt. %, actives) along with some physical data such as viscosity, density, and pH when available. Some ingredients are listed as approximate amounts or as optimal ranges. Some of these compositions represent preferred embodiments and these appear in the various cleaning performance, sprayability, and spray pattern tests. Entries are made in the table as wt. % active material. For example, incorporating 2.6% wt. % of 50% active sodium hydroxide (NaOH) solution will be listed in the table as "1.3%"

because this raw material is only 50% actives and 2.6% "as is" by weight delivers 1.3 wt. % actives. The water that any raw material may contribute to the composition is added into the calculation of total water in the composition. The pH of each composition was greater than about 11. All densities were from about 1.050 to about 1.120 grams/mL. The density of a particular composition may be used to mathematically convert sprayer output in volume to weight, and vice versa.

TABLE 1

Liquid Abrasive Cleanser Formulations

| Ingredients/Properties | Compositions (weight percent actives) | | | | | |
|---|---|---|---|---|---|---|
| | 1 | 2 | 3 | 4 | 5 | 6 |
| Calcium carbonate | 2.0 | 5.0 | 10.0 | 15.0 | 20.0 | 25.0 |
| Polyethylene glycol | 0 | 0 | 0 | 0 | 0 | 0 |
| $C_{10}$-$C_{12}$ Alcohol ethoxylate -8EO | 2.0 | 2.0 | 2.0 | 2.0 | 2.0 | 2.0 |
| Linear alkyl benzene sulfonate | 6.0 | 6.0 | 6.0 | 6.0 | 6.0 | 6.0 |
| Sodium chloride | 1.8-3.0 | 1.8-3.0 | 1.8-3.0 | 1.8-3.0 | 1.8-3.0 | 1.8-3.0 |
| pH adjusting agent(s) | 3.2f | 3.2f | 3.2f | 3.2f | 3.2f | 3.2f |
| Water, fragrance, dyes, preservatives | q.s. | q.s. | q.s. | q.s. | q.s. | q.s. |
| Sprayability | Yes | No | No | No | No | No |

| Ingredients/Properties | Compositions (weight percent actives) | | | | |
|---|---|---|---|---|---|
| | 7 | 8 | 9 | 10 | 11 |
| Calcium carbonate | 10.0 | 10.0 | 10.0 | 10.0 | 10.0 |
| Polyethylene glycol | 0.10a | 0.10b | 0.10c | 0.10d | 0.10e |
| $C_{10}$-$C_{12}$ Alcohol ethoxylate -8EO | 2.0 | 2.0 | 2.0 | 2.0 | 2.0 |
| Linear alkyl benzene sulfonate | 6.0 | 6.0 | 6.0 | 6.0 | 6.0 |
| Sodium chloride | 1.8-3.0 | 1.8-3.0 | 1.8-3.0 | 1.8-3.0 | 1.8-3.0 |
| pH adjusting agent(s) | 3.2f | 3.2f | 3.2f | 3.2f | 3.2f |
| Water, fragrance, dyes, preservatives | q.s | q.s | q.s | q.s | q.s. |
| Sprayability | Yes | Yes | Yes | No* | No* |

Ingredients Key:
a = 4,000 MW PEG, PEG ®4000;
b = 8,000 MW PEG, PEG ®8000;
c = 100,000 MW PEG, Polyox ® WSR N-10;
d = 300,000 MW PEG, Polyox ® WSR N-750;
e = 400,000 MW PEG, Polyox ® WSR N-3000;
f = sodium hydroxide, citric acid, and sodium bicarbonate mixture.
Notes:
*Use of 300,000 or 400,000 MW PEG gave increased sprayer output volume, but that output is in a stream in spite of the sprayer nozzle configuration.

In Table 1, compositions 1-6 represent a group of liquid abrasive cleanser compositions that do not comprise any polyalkylene glycol (e.g. PEG) to improve sprayability. These formulas were produced for the purpose of testing cleaning performance and sprayability as a function of calcium carbonate level. Suffice it to say that although composition 1, having only 2 wt. % calcium carbonate, is sprayable through a Calmar TS-800® trigger sprayer, at least 10 wt. % calcium carbonate (i.e., compositions 3-6) is required for an acceptable level of cleaning performance. However, out of the 10% and greater calcium carbonate compositions that give acceptable cleaning performance, even the 10 wt. % calcium carbonate formula (composition 3) cannot be reliably sprayed through a Calmar TS-800® manual trigger sprayer and is deemed "non-sprayable" by the definition set out herein.

TABLE 2 below summarizes the observations of sprayability when compositions 1-3 were placed in a sprayer bottle equipped with a Calmar TS-800®/0.9 mL per stroke trigger sprayer having a standard dip-tube running into the sprayer bottle and the liquid therein. As mentioned above, the maximum output possible for this model sprayer was 0.9 mL per stroke, and therefore at least 0.6 mL per stroke needs to be repeatedly observed for a composition to be truly "sprayable." Out of these three compositions in Table 2, only composition 1 (having 2 wt. % calcium carbonate) was reliably sprayable. In contrast, composition 2 showed sporadic sprayability, with one of the replicate samples failing to prime after the first week of the test. For composition 3, an abnormally high number of strokes were required to prime the trigger, the spray output was low in comparison to the 0.9 mL/stroke maximum output for this particular Calmar® TS-800 sprayer, the spray pattern was sporadic, and the trigger experienced poor rebound characteristics due to piston and ball sticking.

TABLE 2

Sprayability of Liquid Abrasive Compositions without PEG through a Calmar ® TS-800 Trigger Sprayer

| Composition (from Table 1) | Strokes to prime | Output per stroke (at start of trial) | Output per stroke (after 1-mo trial) |
|---|---|---|---|
| 1 | 5 | 0.68 mL | 0.72 mL |
| 2 | 5* | 0.65 mL | 0.51 mL |
| 3 | 10 | 0.36 mL | 0.42 mL |

Notes:
*One of the replicates for Composition 2 was taken out of the test after the first week because it failed to prime.

TABLE 3 shows the effect of adding polyethylene glycol of various molecular weights to the 10 wt. % calcium carbonate composition that, as discussed above, was deemed not sprayable. Composition 3 (with 10 wt. % calcium carbonate but no PEG) was compared to 10 wt. % calcium carbonate compositions that further comprised 0.10 wt. % of 4,000, 8,000, 100,000, or 300,000 MW polyethylene glycol.

TABLE 3

Sprayability of Liquid Abrasive Compositions with and without PEG through a Calmar ® TS-800/0.9 mL Trigger Sprayer

| Composition (from Table 1) | Wt. %/MW PEG | Output per stroke (at start of trial) |
|---|---|---|
| 3 | 0/NA | 0.36 mL |
| 7 | 0.10/4,000 | 0.72 mL |
| 8 | 0.10/8,000 | 0.76 mL |
| 9 | 0.10/100,000 | 0.80 mL |
| 10 | 0.10/300,000 | 0.64 mL |

As seen in Table 3, addition of 100,000 MW polyethylene glycol to the non-sprayable, 10 wt. % calcium carbonate composition, has a dramatic and unexpected effect on sprayer output volume. Indeed, addition of 0.10 wt. % Polyox® WSR N-10 brings the sprayer output volume of composition to about 89% the 0.9 mL/stroke maximum output volume possible from this model of the Calmar® TS-800 sprayer, approximately doubling the sprayer output seen in the parent composition without the PEG (i.e. comparing composition 3 versus 9). Although not shown in the table, addition of 0.1 wt. % of any of 4,000, 8,000, 400,000 or 900,000 MW PEG also increased the sprayer output of the 10 wt. % calcium carbonate composition without PEG, although the sprayer output volume per stroke for any of these PEG polymers was somewhat less than that achievable through addition of the 100,000 MW PEG. Most importantly, the compositions incorporating either the 400,000 MW or the 900,000 MW PEG were still rated as non-sprayable because the spray pattern for either of these compositions was consistently in the form of a stream, even though the Calmar® sprayer was configured with a conical spray nozzle.

The soil removal tests included a comparative test on soap scum. TABLE 4 summarizes the cleaning performance of compositions 3, 9, and 10. The data is shown as "percent (%) soil removed" (as calculated from reflectance data according to standard test methods). The test was an adaptation of ASTM D5343 (soap scum soil). The test utilized a Gardner Straight-Line Washability Apparatus and a reflectometer. Percent soil removal was calculated from the reflectance values before and after soiling and after cleaning, and the larger the number in the table, the more efficient the cleaning. The general calculation is % soil removed=100(C−S)/(O−S), wherein C is reflectance of a subsequently cleaned specimen, S is the reflectance of a soiled and not yet cleaned specimen, and O is the reflectance of an unsoiled and "blank" specimen.

TABLE 4

Soap Scum Removal Performance

| Composition (from Table 1) | Wt. % and MW of PEG in the composition | % Soil Removed (Soap scum) |
|---|---|---|
| 3 | 0 | 42.0 |
| 8 | 0.1% of 100,000 MW | 41.5 |
| 9 | 0.1% of 900,000 MW | 22.0 |

As evident from Table 4, the molecular weight of the polyethylene glycol has an affect on cleaning performance. Although the 900,000 MW PEG was effective at increasing the volumetric output of the non-sprayable 10 wt. % calcium carbonate composition, the larger molecular weight PEG is seen to reduce cleaning performance by about half Not wishing to be bound by any particular theory, it may be that the 900,000 MW PEG lubricates the abrasive particles all too well, such that the abrasives no longer play a dominate role in the cleaning action, (i.e. reduced physical abrasive removal of the soil from the surface). So although PEG having molecular weight 400,000 or 900,000 can increase the volumetric output of an otherwise non-sprayable abrasive composition, a composition that employs 900,000 MW PEG to increase sprayer output may not be that useful for cleaning soap scum from hard surfaces.

TABLE 5 shows the relationship between the molecular weight of the polyethylene glycol used in the sprayable liquid abrasive composition and the conical spray diameter of the effluent emanating from the manual sprayer. For this test, two different manual trigger sprayers were employed: (1) the Calmar® TS-800 model sprayer with the 0.9 mL/stroke configuration; and (2) the Calmar® Mixor HP model sprayer with the 1.6 mL/stroke configuration. Both sprayers were equipped with the "spray/stream" output nozzle, which is a nozzle that may be rotated into the distinct positions of "spray," "stream," and "X-off." For these experiments, the nozzles were always rotated to the "spray" position. The spray position is designed to produce a conical spray pattern when water or a "water-thin" spray cleaner is dispensed. For the spray pattern measurements, the indicated sprayable liquid abrasive cleanser composition was sprayed through the indicated sprayer at a distance of 20 cm from a vertically positioned 12"×12" gloss black ceramic tile. After the subject composition was primed into the sprayer mechanism by a series of trigger pumps, the nozzle of the sprayer was then aimed directly at the tile and only one pull of sprayer trigger was used to produce the measurable wet spot on the test tile. The resulting wet spot on the tile was then measured. As a reference, water was sprayed through the Calmar® Mixor HP 1.6 mL/stroke sprayer and gave a wet spot that comprised both a smaller central "concentrated" wet area and an outer mist or "halo" area. The inner wet area for water sprayed through the Calmar® Mixor HP trigger sprayer with the nozzle in the "spray" position measured 17 cm diameter and the outer mist/halo area measured 24 cm diameter on average. Also when spraying only water, the Calmar® Mixor HP, rated at 1.6 mL/stroke, gave an average of 1.51 mL/stroke. The goal was to try formulation variants until the spray pattern approached that seen for water. To that end, the 10% abrasives formula comprising 0.1 wt. % of 4,000, 8,000, 100,000, or 300,000 MW polyethylene glycol (i.e., compositions 7-10 from Table 1) were sprayed through both trigger sprayers and the resulting spray patterns measured.

TABLE 5

Spray Patterns and Diameters

| Composition (from Table 1) | Wt. % and MW of PEG in the composition | Outer Spray Cone Diameter (cm) | |
|---|---|---|---|
| | | Calmar ® TS-800 trigger | Calmar ® Mixor-HP trigger |
| 7 | 0.10/4,000 | 18 | 20 |
| 8 | 0.10/8,000 | 16 | 18 |
| 9 | 0.10/100,000 | 14 | 14 |
| 10 | 0.10/300,000 | 0.15 | 0.10 |

What was ultimately learned was that between about 4,000 and 900,000 MW PEG an increase in sprayer output is possible. However, any MW weight much above 100,000 may result in stream output even when a spray nozzle is employed. Furthermore, spray cone diameter shrinks as PEG molecular weight is increased, and cleaning performance (on soap scum) also decreases as the PEG molecular weight is increased. Given these desired attributes (spray volume, cleaning performance, and conical spray pattern close to 20 cm diameter) the optimum PEG to use appears to be from about 4,000 to about 100,000 Daltons.

The scope of the present invention also encompasses a method for converting non-sprayable liquid abrasive compositions into compositions that may be reliably sprayed through a conventional, manual trigger sprayer, such as the Calmar® TS-800 sprayer. As an exemplary embodiment, a method for converting a non-sprayable composition into a sprayable composition comprises the steps of: (1) producing a non-sprayable abrasive composition comprising (i) from about 10 wt. % to about 25 wt. % calcium carbonate abrasive; (ii) from about 1 wt. % to about 10 wt. % of an anionic surfactant; (iii) from about 1 wt. % to about 5 wt. % of a nonionic surfactant; (iv) water; and (v) an amount sufficient of alkaline and/or acidic pH adjusting agent(s) to buffer the pH of the final non-sprayable composition to 10 to about 14; and (2) converting said non-sprayable composition into a sprayable composition by adding from about 0.01 wt. % to about 0.20 wt. % of a polyethylene glycol (PEG) having molecular weight of from about 4,000 to about 1,000,000. Further embodiments of a method of converting non-sprayable compositions into sprayable compositions comprise limiting the nonionic surfactant to alcohol alkoxylates and/or amine oxides, limiting the anionic surfactant to sulfates, sulfonates, and/or fatty acids, and/or narrowing the molecular weight of the polyethylene glycol that makes the compositions sprayable to a more preferred range of 4,000 to 400,000, or the most preferred MW of around 100,000.

The scope of the present invention also encompasses a cleaning system. The cleaning system of the present invention comprises the sprayable liquid abrasive compositions disclosed herein, packaged inside a sprayer package comprising a sprayer bottle with the composition therein and a manual trigger sprayer assembly in fluid communication with the liquid contained and dispensed. In a non-limiting exemplary embodiment, a cleaning system of the present invention comprises: (1) a liquid composition comprising (i) from about 10 wt. % to about 25 wt. % calcium carbonate abrasive; (ii) from about 1 wt. % to about 10 wt. % of an anionic surfactant; (iii) from about 1 wt. % to about 5 wt. % of a nonionic surfactant; (iv) from about 0.01 wt. % to about 0.20 wt. % of a polyethylene glycol (PEG) having molecular weight of from about 4,000 to about 1,000,000; (v) an amount sufficient of alkaline and/or acidic pH adjusting agent(s) to buffer the final composition to a pH of from about 10 to about 14; and, (vi) water; and (2) a sprayer package comprising a sprayer bottle with an enclosed volume containing the composition, and a manual trigger sprayer assembly in fluid communication with the composition within the bottle.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

We have described new liquid abrasive cleanser compositions that are sprayable through conventional manual trigger sprayers where the compositions comprise a polyalkylene glycol, a nonionic surfactant, a pH adjusting agent, an abrasive, and water, and wherein the composition is made sprayable by the addition of the polyalkylene glycol. The more preferred compositions that are both sprayable and that show acceptable cleaning performance comprise polyethylene glycol as the polyalkylene glycol, and which also include an anionic surfactant. The addition of polyethylene glycol having molecular weight of from about 4,000 to 1,000,000, more preferably from about 4,000 to about 400,000, and most preferably from about 4,000 to 100,000 Daltons, dramatically converts non-sprayable liquid abrasive cleanser compositions having 10 wt. % calcium carbonate into truly sprayable compositions that show large conical spray patterns similar to what a consumer would see spraying water-thin hard surface cleaners. Liquid abrasive cleanser compositions with 10 wt. % or greater calcium carbonate would not be sprayable without polyethylene glycol. A method is also described for converting a non-sprayable liquid abrasive composition into a sprayable liquid abrasive composition comprising the addition of 4,000 to 400,000 MW PEG to a non-sprayable composition comprising at least 10 wt. % calcium carbonate, surfactants, pH adjusting agent(s), and water. Lastly, a cleaning system is described that comprises a sprayable liquid abrasive composition packaged in a sprayer package comprising a bottle with an enclosed volume for containing the composition, and a manual trigger sprayer assembly in fluid communication with the composition for manually dispensing the composition.

We claim:

1. A method of controlling the spray pattern of a sprayable liquid abrasives composition sprayed from a manual trigger sprayer, said method comprising the steps of:

a. obtaining a liquid composition comprising: (i) from about 10 wt. % to about 25 wt. % calcium carbonate particles; (ii) from about 1 wt. % to about 10 wt. % of an anionic surfactant; (iii) from about 1 wt. % to about 5 wt. % of a nonionic surfactant; (iv) water; and (v) an amount sufficient of alkaline and/or acidic pH adjusting agent(s) to buffer the final composition to a pH of from about 10 to about 14; and b. adding from about 0.01 wt. % to about 0.20 wt. % of a polyethylene glycol having molecular weight of from about 8,000 to about 100,000 Daltons to produce a sprayable liquid abrasives composition having a controlled spray pattern.

2. The method of claim 1, wherein said anionic surfactant is chosen from the group consisting of sulfates, sulfonates, and fatty acid soaps, and mixtures thereof.

3. The method of claim 1, wherein said nonionic surfactant is chosen from the group consisting of alcohol ethoxylates, and amine oxides, and mixtures thereof.

4. The method of claim 1, wherein said pH adjusting agent is selected from the group consisting of sodium hydroxide, potassium hydroxide, magnesium hydroxide, ammonium hydroxide, ammonia, primary amines, secondary amines, tertiary amines, monethanolamine, diethanolamine, triethanolamine, sodium carbonate, potassium carbonate, sodium bicarbonate, potassium bicarbonate, sodium sesquicarbonate, sodium silicate, sodium borate, monosodium citrate, disodium citrate, trisodium citrate, hydrochloric acid, nitric acid, sulfamic acid, methane sulfonic acid, sulfuric acid, phosphoric acid, citric acid, malic acid, lactic acid, formic acid, and ascorbic acid, and mixtures thereof.

5. The method of claim 1, wherein said polyethylene glycol has a molecular weight of about 100,000.

6. The method of claim 5, wherein said polyethylene glycol is present in an amount of from about 0.05 wt. % to about 0.15 wt. %.

7. The method of claim 6, wherein said nonionic surfactant is an alcohol ethoxylate comprising a $C_{10}$-$C_{18}$ alcohol ethoxylated with an average of 4 to 12 moles ethoxylation.

8. The method of claim 6, wherein said anionic is a linear alkyl benzene sulfonate.

9. The method of claim 6, wherein said the calcium carbonate is present in an amount of about 2 wt. % to about 20 wt. %.

10. The method of claim 9, wherein said controlled spray pattern is conical shaped when said sprayable composition is sprayed through a manual trigger sprayer equipped with a conical spray nozzle, and wherein said conical spray pattern emanating from said sprayer wets a circular area of at least 12 cm diameter when said sprayable composition is sprayed at a vertical surface from a distance of 20 cm.

* * * * *